US006382719B1

(12) United States Patent
Heidmann et al.

(10) Patent No.: US 6,382,719 B1
(45) Date of Patent: May 7, 2002

(54) BACK CONSTRUCTION

(75) Inventors: Kurt Heidmann, Grand Rapids, MI (US); Thomas B. Eich, Palo Alto, CA (US); Jonathan B. Hadley, Holland; Christopher J. Norman, Byron Center, both of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/565,768

(22) Filed: May 4, 2000

(51) Int. Cl.[7] ..... A47C 3/025

(52) U.S. Cl. ..... 297/228.1; 297/219.1; 297/230.13; 297/284.4; 297/300.1; 297/300.4

(58) Field of Search ..... 297/228.1, 230.1, 297/230.11, 230.12, 284.4, 300.1, 300.2, 300.3, 300.4, 312, 317, 452.18, 452.31

(56) References Cited

U.S. PATENT DOCUMENTS

| | | | | | |
|---|---|---|---|---|---|
| 4,744,603 | A | * | 5/1988 | Knoblock | 297/300.4 |
| 5,123,702 | A | | 6/1992 | Caruso | |
| D327,988 | S | | 7/1992 | Citterio | |
| D328,199 | S | | 7/1992 | Citterio | |
| D330,478 | S | | 10/1992 | Wogoman et al. | |
| D335,596 | S | | 5/1993 | Wogoman et al. | |
| 5,281,002 | A | * | 1/1994 | Dauphin | 297/219.1 X |
| 5,318,346 | A | * | 6/1994 | Roossien et al. | 297/300.1 |
| 5,499,859 | A | | 3/1996 | Angell | |
| 5,540,481 | A | * | 7/1996 | Roossien et al. | 297/300.4 |
| 5,551,752 | A | * | 9/1996 | Lovegrove et al. | 297/284.4 X |
| 5,567,012 | A | * | 10/1996 | Knoblock | 297/300.4 X |
| D391,791 | S | | 3/1998 | Smith | |
| 5,806,825 | A | * | 9/1998 | Hanley | 297/228.1 X |
| 5,816,654 | A | * | 10/1998 | Ellis | 297/230.13 X |
| 5,871,258 | A | | 2/1999 | Battey et al. | 297/317 |
| D411,395 | S | | 6/1999 | Edwards | |
| 5,975,634 | A | * | 11/1999 | Knoblock et al. | 297/300.4 |
| 6,179,384 | B1 | * | 1/2001 | DeKraker et al. | 297/284.4 |

* cited by examiner

*Primary Examiner*—Jose V. Chen
*Assistant Examiner*—Rodney B. White
(74) *Attorney, Agent, or Firm*—Price Heneveld Cooper DeWitt & Litton

(57) ABSTRACT

A back construction for seating includes a back frame having an elongated section and a non-uniformity caused by a molding gate in a center of the elongated section. An aesthetic cover is configured to overlay a portion of the elongated section and snappingly engages the elongated section to cover the non-uniformity. A back shell is connected to the back frame by a connection that includes internal connecting structure providing strength to the connection. A housing surrounds the internal connecting structure too provide an aesthetic appearance to the connection. The back shell has a channel defined along its bottom edge, and an elongated bracket has an intermediate section shaped to fit into the channel. The bracket is retained in the channel by a nose-shaped top edge and bottom screws, such that the bracket is easily assembled yet securely held.

27 Claims, 8 Drawing Sheets

Fig. 2
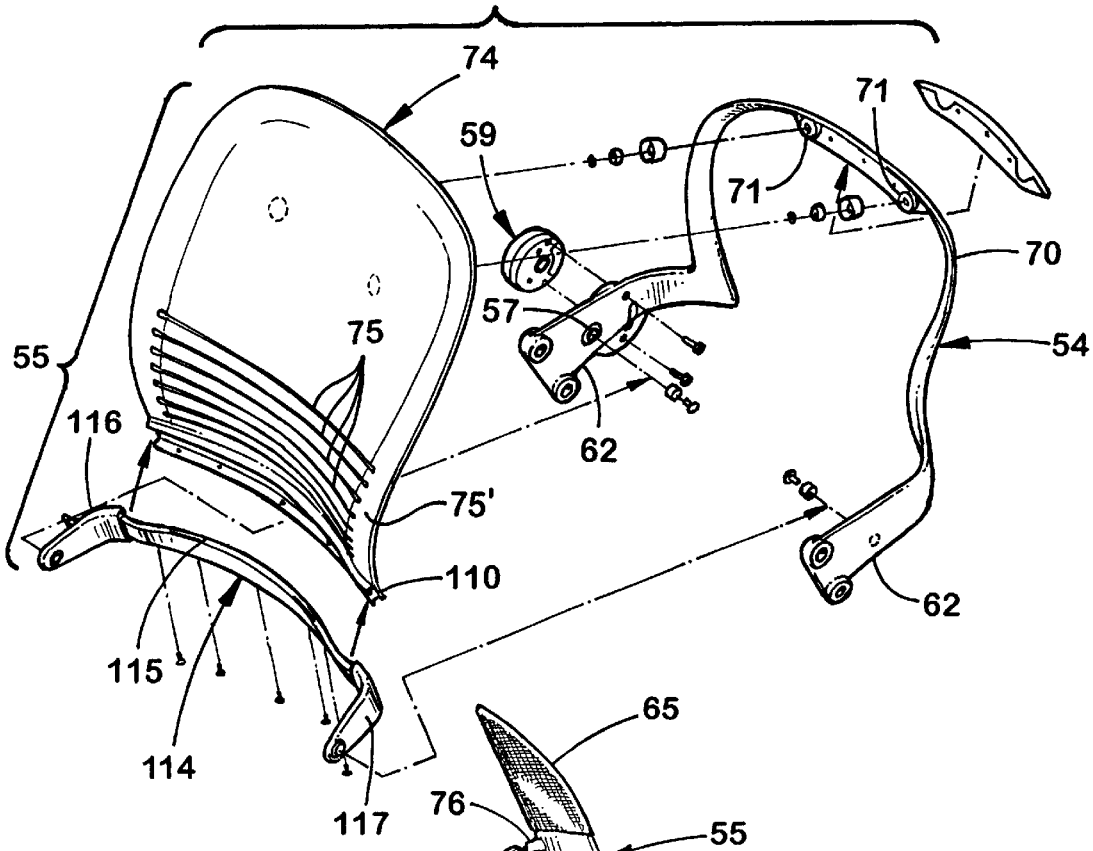
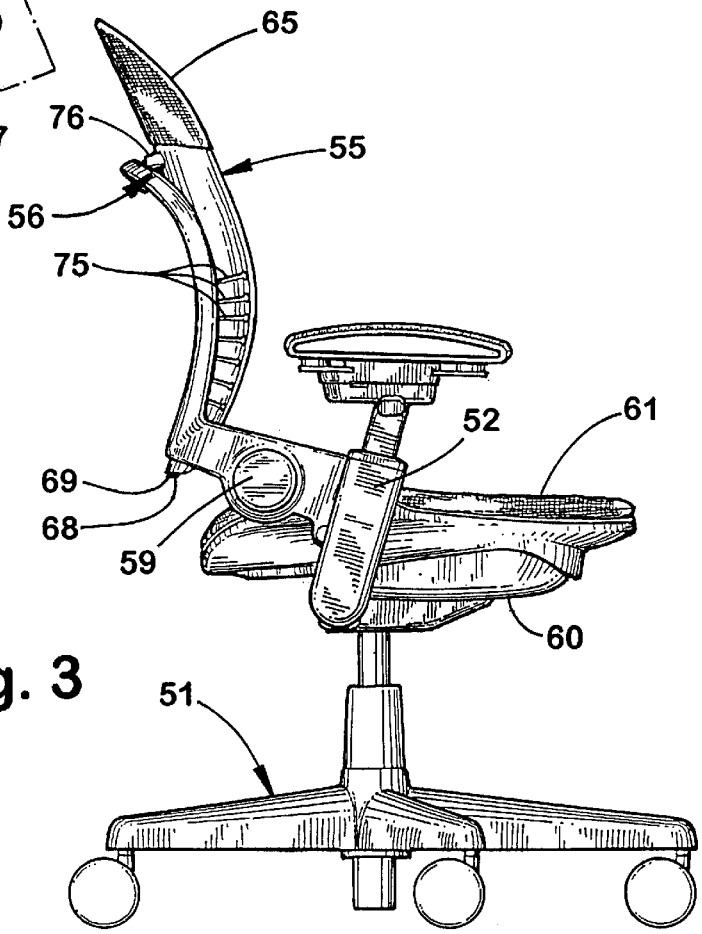
Fig. 3

BACK CONSTRUCTION

BACKGROUND OF INVENTION

The present invention relates to back constructions for seating for supporting the torso of seated users, and more specifically relates to back constructions adapted to facilitate manufacture while maintaining good aesthetics, low part count, optimized assembly, and low cost.

Recently, some seating manufacturers have designed "high-tech" looking chairs with backs including exposed frames and flexible back support structures. While this often eliminates covers and other "extra" pieces, it also can result in problems, because parts that usually are not finished and that include marks and rough edges caused by manufacturing are now visible or even emphasized. It can be expensive and costly to finish these parts. Further, parts that are structurally finished may fail visual inspection, causing some of the expensive parts to be thrown away as scrap.

In particular, the assignee of the present invention has designed an innovative and highly successful chair called the LEAP™ chair (see U.S. Pat. No. 5,871,258, issued Feb. 16, 1999) that includes a very comfortable and flexible back shell assembly, and an arching back frame that extends from sides of its seat to a top of the back shell assembly for supporting the back shell assembly at top and bottom connections. Early designs of the LEAP™ chair include a very comfortable and flexible back shell comprising a polymeric sheet (called herein a "back shell"). The early designs further include a metal "belt" bracket that was insert molded into and extended along a bottom edge of the back shell. This construction worked well and was able to withstand the stresses associated with this design. However, the process of insert molding is expensive and non-repairable, and can generate significant scrap during manufacture. A less expensive alternative is desired that facilitates manufacture, permits repair, and yet that maintains the good appearance of the chair.

The LEAP™ chair includes top connections that connect a top of its flexible back shell assembly to the back frame. These top connections are in a high visibility area. Further, many consumers like to see the flexible back shell, and often they prefer not to have any cushion or fabric covering. However, this results in the top connection being even more visible. Specifically, the problem is that the top connections must be very secure, yet permit easy assembly and also look clean and be aesthetically acceptable. Preferably, the connections should not include any visible screws or the like. Also, the top connections in the LEAP™ chair must permit some flexing and movement at the top connections, without binding the polymeric material of the back shell. Otherwise, concentrated stresses in the back shell, which occur when the back shell is flexed to an extreme position, can stress the polymeric material to such an extent that visible white stress marks can occur at the high stress areas. This problem became noticed in the early designs of the LEAP™ chair when the back shell was not covered with an upholstered cushion, and when the back shell was flexed to a maximum bent condition. The white stress locations showed on a face of the back shell, which a person sees as they approach and sit down in the chair.

An improved back frame for the LEAP™ chair is also desired. The physics of manufacturing the arching back frame make it preferable to mold the part with material flowing into opposing and balanced halves of the mold cavity from a center location through what is known as a molding gate. A problem is that the high material flow and shearing forces at the molding gate can cause part defects and surface blemishes in the back frame at the molding gate. Further, sharp edges and protrusions can occur at the molding gate where the "runner" (i.e. the material that flows toward but that does not enter the molding gate) and the part material just inside the molding gate are separated at an end of the molding process. Thus, the molding process requires extra effort to trim and smooth over these areas of the "raw" molded back frame. These blemishes and jagged edges would normally not be seen since, in most chairs, they are covered by upholstery or cushion material. However, as noted above, the present LEAP™ back frame is not covered.

Accordingly, a back construction solving the aforementioned difficulties and problems, and having the aforementioned advantages is desired.

SUMMARY OF THE PRESENT INVENTION

In one aspect of the present invention, a back construction for seating includes a structural back frame having an elongated section with a visible area where a blemish or other visible defect is undesirable, and an aesthetic cover engaging opposing surfaces on the elongated section and that is shaped to aesthetically cover the visible area.

In another aspect, a back construction for seating includes a back frame, a back shell, and a connection connecting the back shell to the back frame. The connection includes internal connecting structure on the back shell and the back frame that securely engage to hold the back shell to the back frame. The connection further includes an external retainer housing surrounding the internal connecting structure, the external retainer housing including a tubular sleeve that provides an aesthetic appearance around the internal connecting structure.

In another aspect, a back construction includes a back support having sides and a bottom edge and a channel defined along the bottom edge. An elongated bracket is provided having a center section shaped to fit into the channel. The bracket is retained in the channel and has end sections that extend forwardly from the sides of the back support. The end sections are adapted to pivotally engage a back frame structure.

These and other features, advantages, and objects of the present invention will be further understood and appreciated by those skilled in the art by reference to the following specification, claims and appended drawings.

BRIEF DESCRIPTION OF THE DRAWINGS

FIG. 2 is an exploded perspective view of the back construction shown in FIG. 1;

FIG. 3 is a cross-sectional view of the back construction shown in FIG. 2;

DETAILED DESCRIPTION OF PREFERRED EMBODIMENTS

Figure 1:
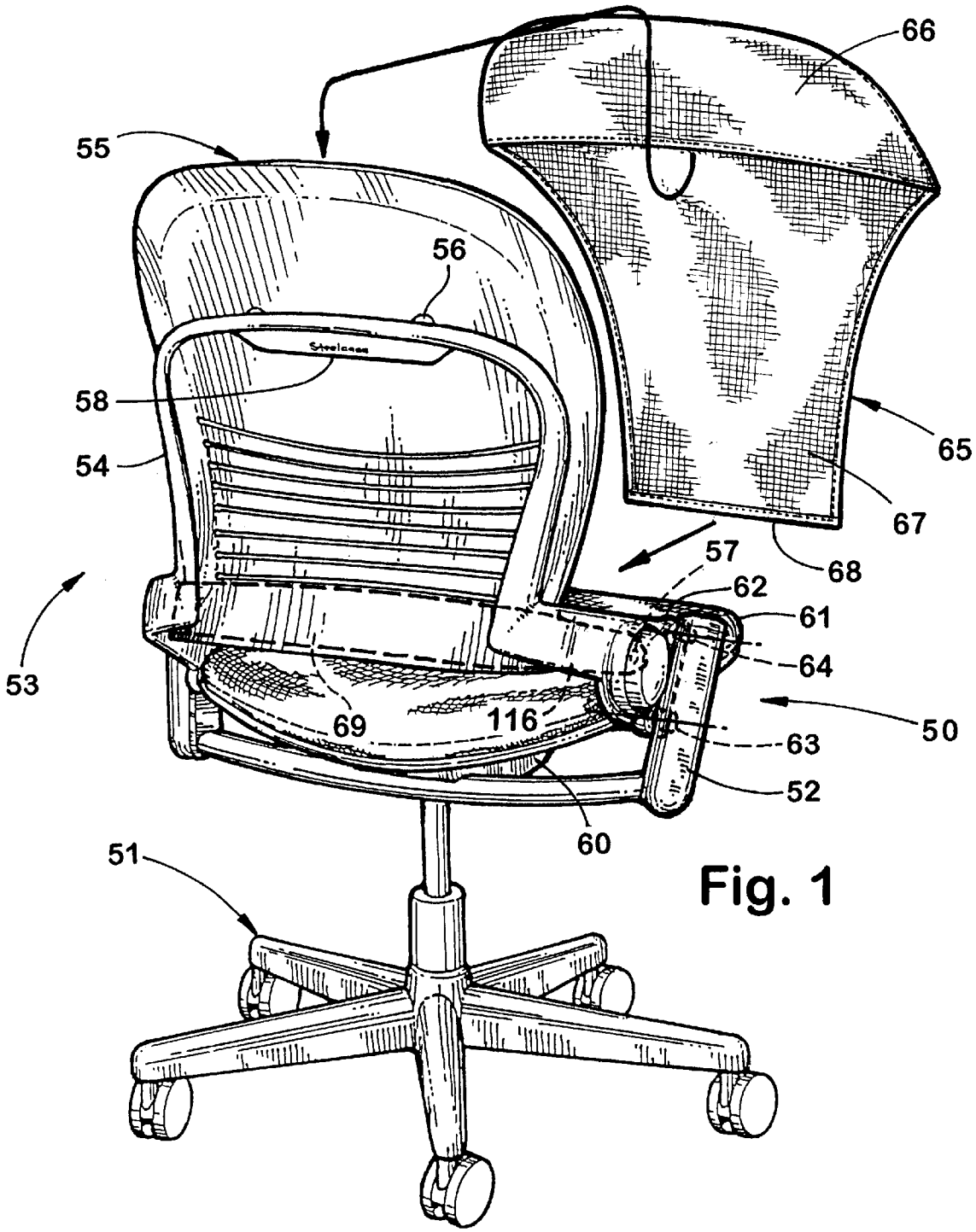
FIG. 1 is a perspective view of a chair with a back construction embodying the present invention.
Figure 4:
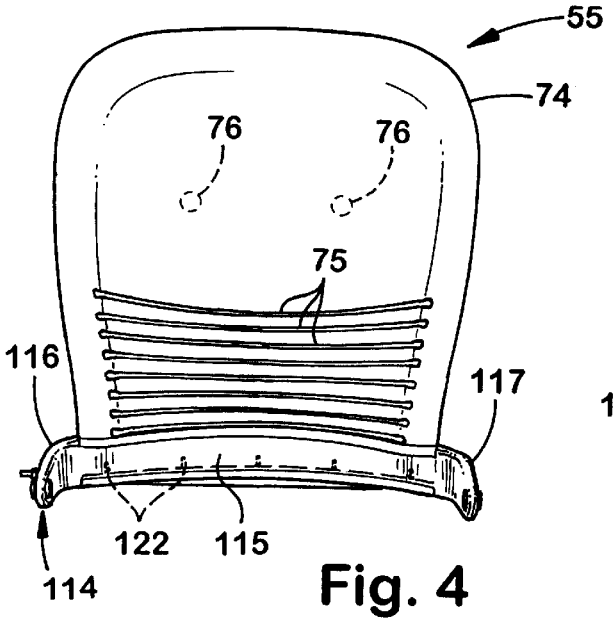
FIGS. 4–5 are front and side views of the back construction shown in FIG. 3.
Figure 5:
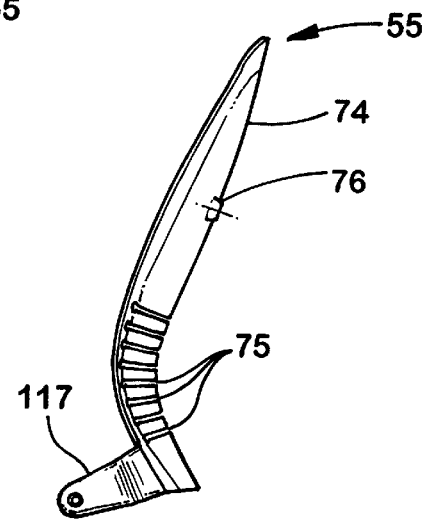

A chair 50 (FIG. 1) includes a base 51 having stationary side supports 52, and a back construction 53 operably connected to the side supports 52 for recline. The back construction 53 includes a back fame 54 and a back shell assembly 55 pivoted to the back frame 54 at top and bottom pivot connections 56 and 57. The back frame 54 and back shell assembly 55 include improved pivot connections 56 and 57 that are secure, yet that have improved aesthetics, improved assembleability, and lower cost, as discussed in more detail below. An aesthetic cover 58 is attached to a center of the back frame 54 to further improve aesthetics of the back frame 54, while also reducing cost, as discussed below.

The components of the present chair 50 are sufficiently disclosed herein for an understanding of the present invention. However, if a more detailed discussion of the chair, its advantages and operation is desired, the reader's attention is directed to the disclosure of the U.S. Pat. No. 5,871,258 (issued Feb. 16, 1999), which is incorporated herein in its entirety. An earlier version of the present chair 50 is shown in U.S. Pat. No. 5,871,258, but the components and operation are of interest.

Generally described, the base 51 of the present chair 50 includes an under-seat control housing 60, and a seat 61 slidably positioned on the housing 60. The back frame 54 includes forward end sections 62 pivoted to the stationary side supports 52 at back frame pivots 63, and also pivoted to the seat at moving seat pivots 64. As the back construction 53 is reclined, the seat 61 slides forwardly, such that a seated user remains at a relatively stable position relative to a worksurface during the recline.

As shown in FIG. 1, the illustrated back shell assembly 55 can be covered by a removable upholstery assembly 65. The upholstery assembly 65 includes a sock-like top section 66 that mateably engages a top of the back shell assembly 55, and further includes a bottom stiff edge 68 formed by a stiff strip sewn to a bottom of the fabric 67 of the upholstery assembly 65. The stiff edge 68 releasably engages a channel 69 along a bottom edge of the back shell assembly 55 with a "zipper"—like action. The fabric 67 is stretchable and is held in tension against the back shell assembly 55 by the top and bottom components 66 and 68. The upholstery assembly 65 characteristically does not cover the top and bottom pivot connections 56 and 57. Further, it is noted that the upholstery assembly 65 can be totally left off of the back shell assembly 55. Thus, the top and bottom connections 56 and 57 are highly and easily visible, and there is a need for the top and bottom connections 56 and 57 to be visually "clean" and uncluttered in appearance. At the same time, the present chair requires secure connections between the back frame 54 and the back shell assembly 55, and further there is a need for efficient yet repairable assembly. These requirements lead to conflicts in terms of size, structure, and appearance of components, such that design of the top and bottom connections, and more generally, the design of the back frame and back shell assembly, are not easily accomplished.

Figure 19:
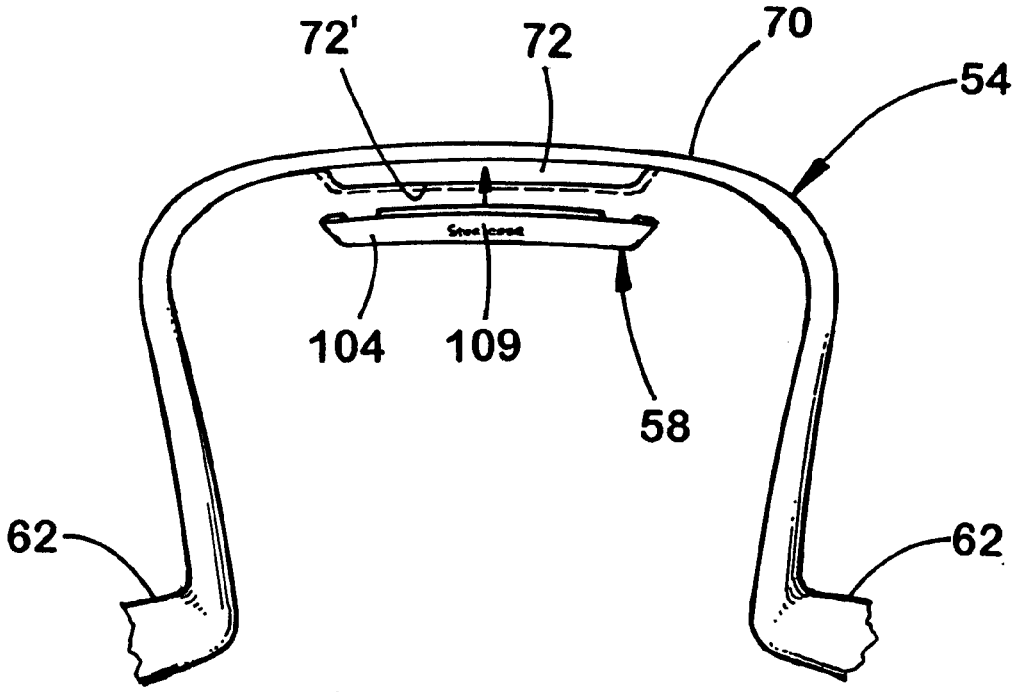
FIGS. 19–19A are rear and front fragmentary views of the back frame and nameplate cover shown in FIG. 18.
Figure 19A:
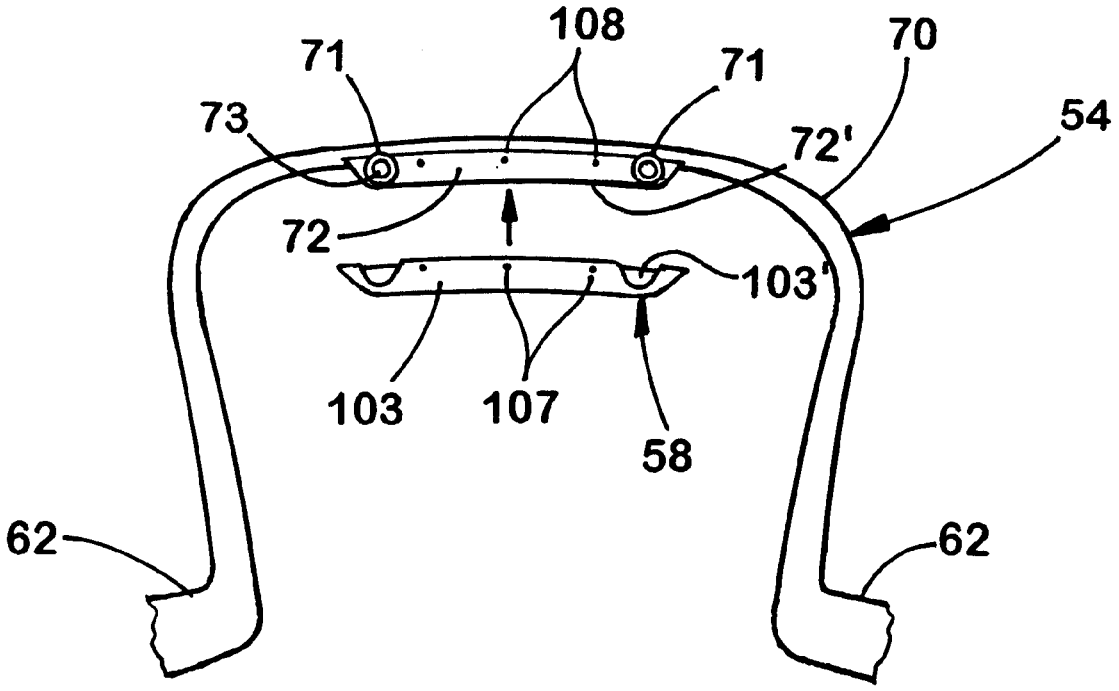
Figure 20:
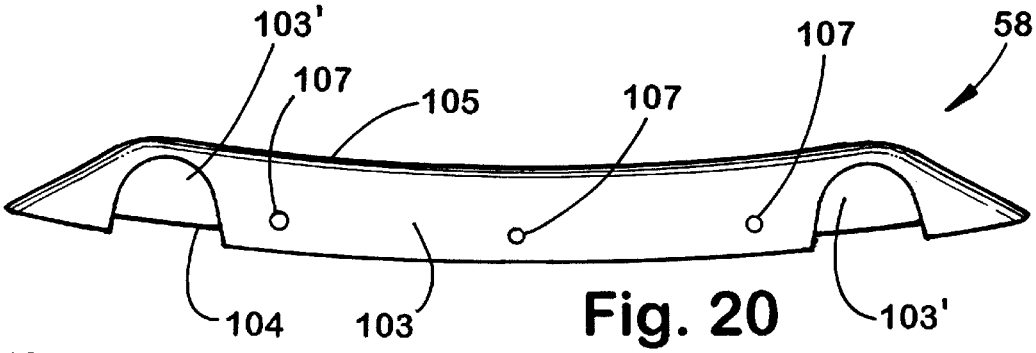
FIGS. 20–23 are front, bottom, rear, and cross-sectional end views of the nameplate cover shown in FIG. 19, the FIG. 23 being a cross-section along line XXIII—XXIII in FIG. 22.
Figure 21:
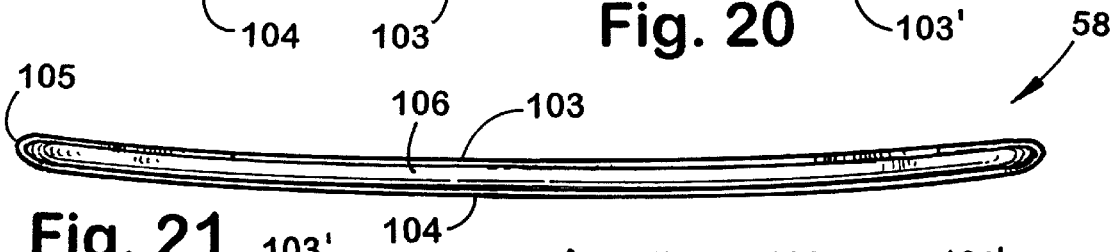
Figure 22:
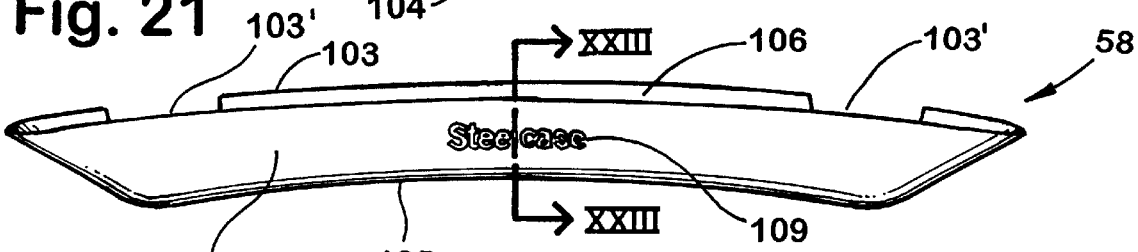
Figure 23:
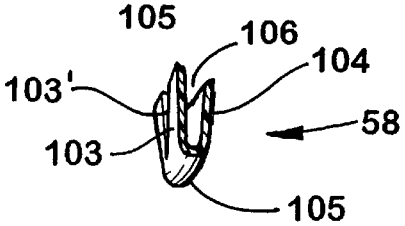

The illustrated back frame 54 (FIG. 2) is a symmetrical part molded from polymeric material, such as glass reinforced nylon. The back frame 54 includes an elongated center section 70 shaped like an arch, with the integrally-formed end sections 62 extending from each end. A pair of forwardly-extending enlarged mounts 71 (FIG. 19A) are located in a center section of the elongated section 70, and a reinforcement web or flange 72 extends between the mounts 71. A cross-section through the flange 72 and the center section 79 forms a T-shaped beam section. A multi-diameter stud 73 is retained in each mount 71 and extends forwardly toward the back shell assembly 55. The stud 73 forms a "back frame" portion of the top connectors 56.

The back shell assembly 55 (FIG. 2) includes a back shell 74 made of a flexible sheet of polymeric material. The back shell 74 includes a plurality of horizontal slots 75 that extend across a lower lumbar region of the back shell 74. The slots 75 terminate about an inch short of an edge of the back shell 74, leaving leaf-spring-like vertical edge strips 75' that provide flexibility in a lumbar area of the back. The upper section of the back shell 74 does not include horizontal slots and is characteristically less flexible so that it is sufficiently stiff to support a seated user leaning against it. Further, it is sufficiently rigid to stably support the connector structures 76 described below.

Figure 6:
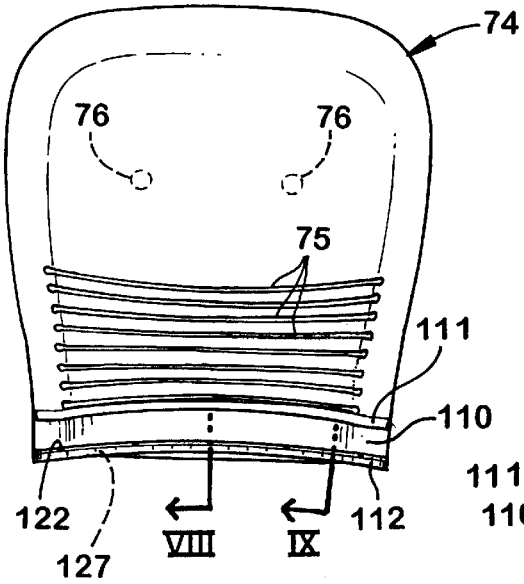
FIGS. 6–7 are front and side views of the back shell of the back construction shown in FIG. 4.
Figure 7:
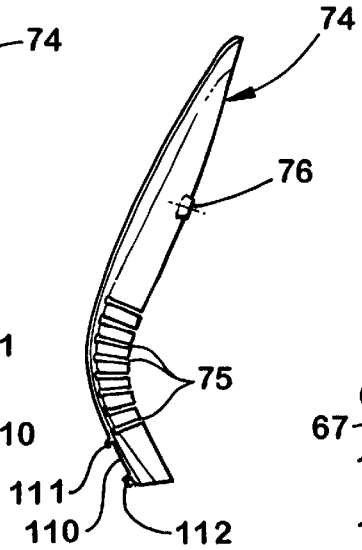
Figure 8:
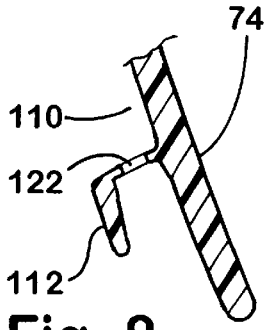
FIG. 8 is a cross-section taken along line VIII—VIII in FIG. 6.
Figure 9:
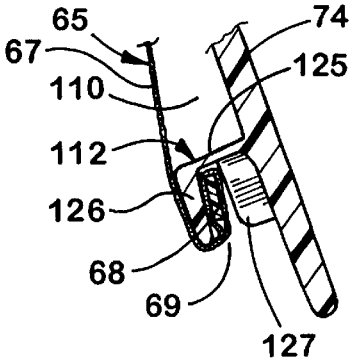
FIG. 9 is an enlarged view of the circled area IX in FIG. 3.
Figure 16:
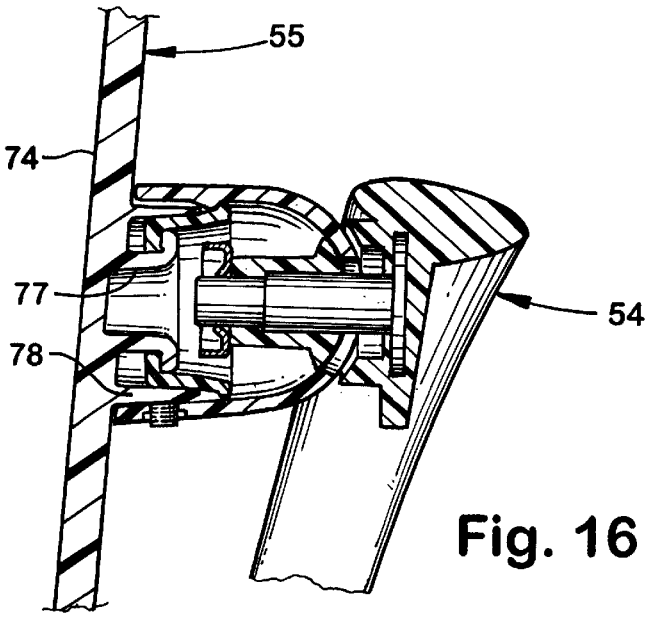
FIG. 16 is a fragmentary cross-section taken along the line XVI—XVI in FIG. 4.
Figure 17:
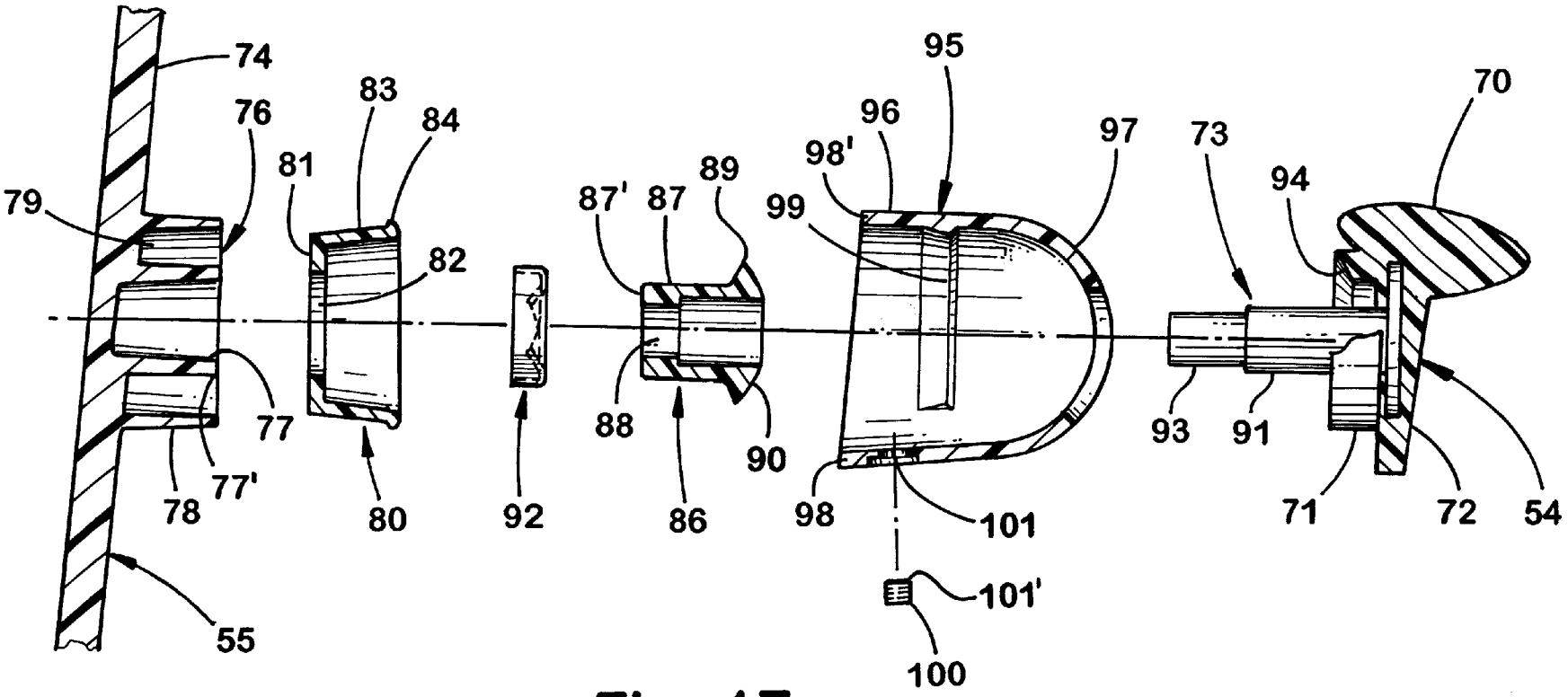
FIG. 17 is an exploded view of FIG. 16.
Figure 18:
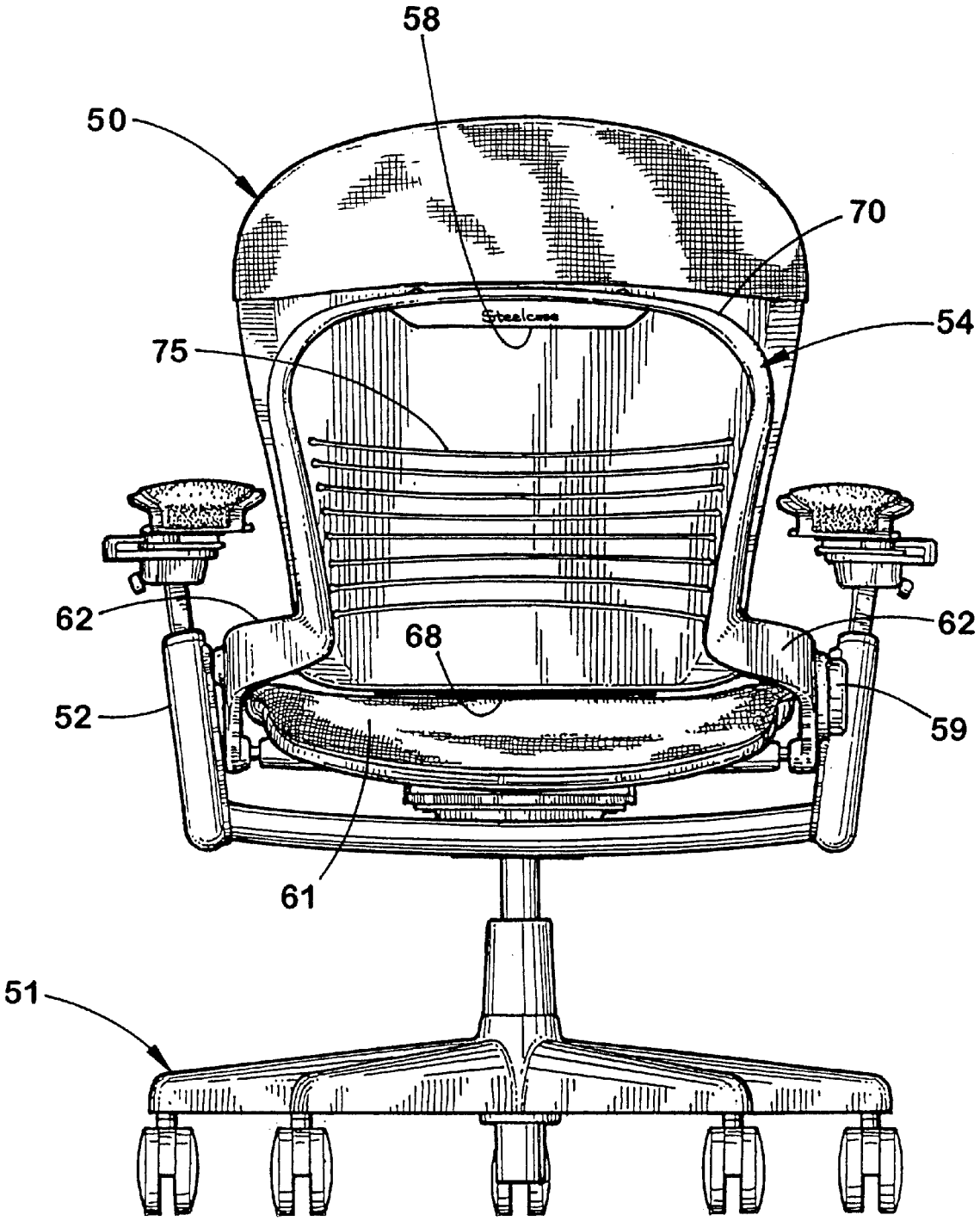
FIG. 18 is a review of the chair, shown in FIG. 1.

The back shell 74 is a molded sheet that is about 0.150 inch thick, and is shaped to comfortably support a seated user. The two connector structures 76 (i.e. the "back shell" portion of the top pivot connections 56) are formed in an upper section of the back shell 74 at locations spaced several inches apart. (See FIGS. 6–7.) Each connector 56 includes a pair of concentric annular rings 77 and 78 (FIG. 17) forming an annular space 79 therebetween. A tubular member 80 made of strong/tough plastic material has a bottom with an in flange 81 and an axial hole 82 therein, and has a top section 83 and outer lip 84. The bottom of the tubular member 80 is positioned in the space 79 with the inner ring 77 extending through the hole 82. After assembly, a top of the inner ring 77 is deformed outwardly over the in flange 81 to form a lip 77' that permanently secures the tubular member 80 to the associated connector structure 76. (See FIG. 16.)

The top connection 56 (FIG. 17) includes a bushing 86 having a sleeve section 87 with a through hole 88. An out lip 89 is located on an end of the bushing 86 and defines a large-radiused end surface 90. The through hole 88 closely receives a larger diameter shaft section 91 of the stud 73, with a flat end 87' of the sleeve section 87 being equal to or slightly beyond an end of the shaft section 91, where a smaller diameter shaft section 93 of the stud 73 begins. A sheet metal-stamped nut 92 is shaped to threadably engage the smaller diameter shaft section 93, to retain the bushing 86 on the stud 73. The radiused end surface 90 of bushing 86 is positioned proximate but spaced from a similarly-radiused ring-shaped surface 94 on enlarged mount 71.

An aesthetic cover 95 (FIG. 17) includes a cylindrical sleeve section 96 that surrounds the top connection 56. A radiused end 97 fits between the radiused end surface 90 of the bushing 86 and the ring-shaped surface 94, and slidably engages both surfaces 90 and 94. This provides some rotational flexibility to the top connection 56 while simultaneously providing a clean appearance. The other end 98 is located proximate the rear surface of the back shell 74. The end 98 includes an arcuate cut-away section 98' cut short a small amount at the top and/or bottom of the end 98 to provide increased clearance to the back shell 74. Thus, when the back shell 74 is flexed to an extreme (e.g. where a lumbar section of the back shell 74 is flexed toward a planar shape, or where a top section of the back shell 74 is pressed rearwardly by a standing person leaning on the chair), the clearance provided by cut-away section 98' reduces concentration of stress at the top connection 56. This reduces a tendency to create white stress marks when flexing the back shell 74.

Ridges 99 are formed on an inside of the sleeve section 96 for releasably engaging the outer lip 84 of the out flange 83 of the tubular member 80. The center point of the illustrated ridges 99 are positioned about 120 degrees apart, and the ridges 99 extend about 60 to 90 degrees. However it is contemplated that any ridge or protrusion will work that engages the lip 84 with sufficient force to retain the top connection 56 together. A screw 100 threadably engages a hole 101 in the sleeve section 96 at a location opposite the ridges 99 but at a location slightly closer to the tubular portion 87 of the bushing 86. During assembly, the screw 100 is turned into the hole 101 until its inner end 100 ' engages the bushing 86, biasing it into the ridges 99 where it is securely retained. The screw 100 and hole 101 are located on a bottom of the sleeve section 96, such that they are not easily visible. Thus, a very secure connection is made, but which is easily made and yet which is also releasable and substantially hidden from view.

As noted above, a pair of forwardly-extending enlarged mounts 71 are located in a center section of the elongated section 70 and a reinforcement web or flange 72 extends between the mounts 71. A cross-section through the flange 72 and the center section forms a T-shaped beam section, with the boss-like mounts 71 located at each end. An aesthetic cover 58 (FIGS. 20–23)is made from molded molded polymeric material, and is stamped into a C shaped cross-section with front and rear panels 103 and 104 and a radiused connecting wall 105 defining a cavity 106. (The front cover 103 faces the back shell 74 and is less visible, while the rear panel 104 is highly visible from a rear of the chair.) The cavity 106 is shaped to receive the reinforcement web 72. The front panel 103 includes arcuate cutouts or recesses 103' that mateably nest against the mounts 71 on the back frame 54. The front panel 103 further includes locator holes 107 shaped to receive locator protrusions 108 (FIG. 19A) that extend forwardly on the reinforcement web 72 to accurately locate the cover 58 on the web 72. The molding gate 72' is located at a bottom/center edge of the reinforcement web 72, and the radiused connecting wall 105 and walls 103 and 104 cover the bottom edge of the reinforcement web 72. Further, the rear panel 104 covers a rear side of the reinforcement web 72, which is the most visible portion of the reinforcement web 72. The aesthetic cover 58 is configured to snappingly engage the reinforcement web 72, with the front and rear panels 103 and 104 springing apart far enough for the locator protrusions 108 to snap into the holes 107. The connecting wall 105 then resiliently flexes the front and rear panels 103 and 104 back together to a retained position. The cover 58 is relatively inexpensive to make, and is easily attached. Further, the rear panel 104 provides an excellent surface for receiving indicia, such as an identifying trademark or symbol for the chair, such as is illustrated by stamped in indicia 109.

Figure 13:
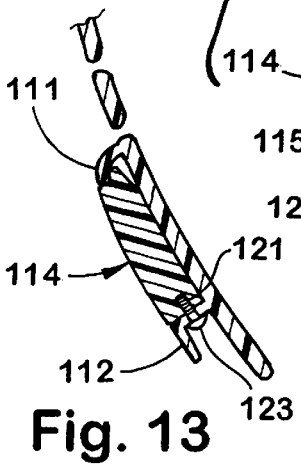
Figure 15:
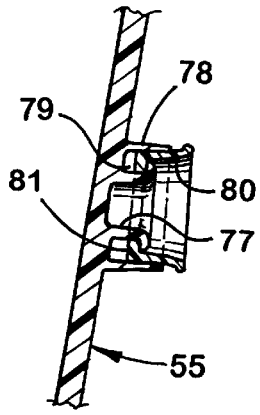
FIG. 15 is a fragmentary cross-section taken along the line XV—XV in FIG. 6.
Figure 12:
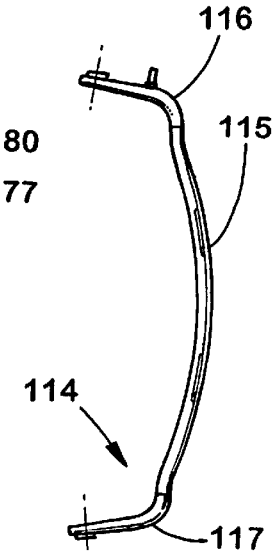
FIGS. 10–12 are the belt bracket shown in FIG. 4.
Figure 10:
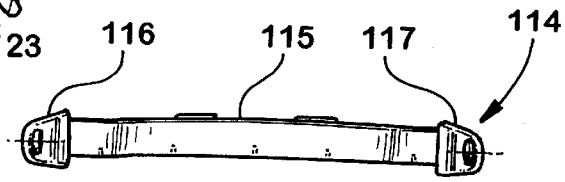
Figure 11:
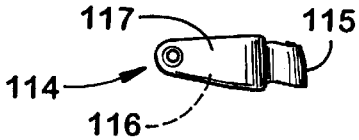

A horizontal recess or channel 110 (FIGS. 6–9) is defined along a bottom of the back shell 74 by a pair of horizontal flanges 111 and 112. The top flange 111 is located just below the bottom-most horizontal lumbar slot 75 on the back shell 74 and is curved downwardly to form a downwardly facing concave space 113 (FIG. 13). An elongated bracket 114 (FIGS. 10–12) (sometimes called a "belt bracket" herein) includes an intermediate section 115 that extends a width of the back shell 74, and further includes end sections 116 and 117 that extend forwardly from the ends of the intermediate section 115. The end sections 116 and 117 are pivoted to the end sections 62 of the back frame 54 at bottom pivot connections 57. An adjustable torsion force generating lumbar device 59 is attached to one of the pivots 57 to bias the belt bracket 114. This bias causes the back shell 74 to move to a concave shape where the lumber area of the back shell 74 protrudes forwardly and ergonomically supports a seated user.

Figure 14:
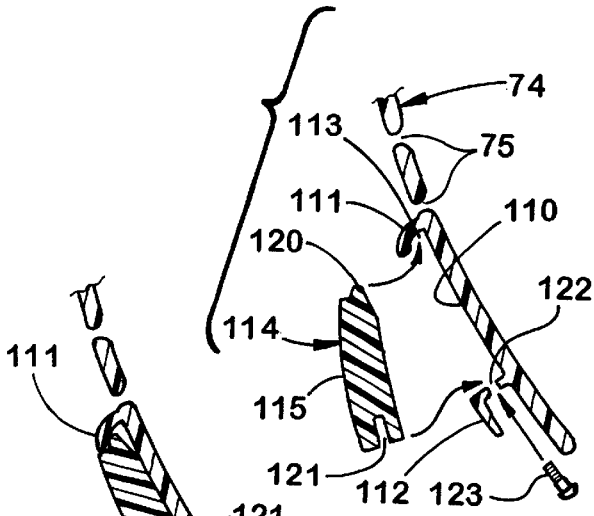
FIGS. 13–14 are cross-sections showing assembly of the belt bracket of FIG. 10 and the back shell of FIG. 6.

The cross-section of intermediate section 115 (FIG. 14) includes a top nose 120 that fits mateably into the concave space 113, and the remainder of the intermediate section 115 fits closely between the flanges 111 and 112 into the channel 110. A plurality of holes 121 extend vertically upwardly into the intermediate section 115, and they align with holes 122 in the bottom horizontal flange 112 when the belt bracket 114 is seated between the flanges 111 and 112. Screws 123 extend through the holes 122 and threadably into the holes 121 to secure the belt bracket 114 in place.

In a preferred form, the belt bracket 114 is molded of polymeric material, such as glass reinforced polyester. Nonetheless, it is specifically contemplated that a bracket made of metal, composite, or other material.

The bottom horizontal flange 112 is L-shaped (FIG. 9), and includes a horizontal leg 125 that extends rearwardly from the back shell 74, and a vertical leg 126 that extends downwardly. The vertical leg 126 is spaced from the back shell 74. A plurality of small ribs rectangular or gussets 127 extend from the back shell 74 about three-fourths of the way from the back shell 74 to the vertical leg 126. The channel 69 is formed between the outer end of small ribs 127 and the vertical leg 126 along the bottom of the back shell 74. The channel 69 is sufficient in thickness to receive the stiff edge 68, but closely receives it. The low clearance and also the tension on the fabric 67 (which causes a torsional force on the stiff edge 68 tending to cause friction of the stiff edge 68 in the channel 69) holds the stiff edge 68 in the channel 69.

In the foregoing description, it will be readily appreciated by those skilled in the art that modifications may be made to the invention without departing from the concepts disclosed herein. Such modifications are to be considered as included in the following claims, unless these claims, by their language, expressly state otherwise.

The embodiments of the invention in which an exclusive property or privilege is claimed are defined as follows:

1. A back construction for seating comprising:

a structural back frame having an elongated section with a visible area where a blemish or other visible defect is undesirable, the visible area including a flange with a molding gate thereon; and an aesthetic cover engaging opposing surfaces on the elongated section and that is shaped to aesthetically cover the visible area, the aesthetic cover including opposing panels that engage the opposing surfaces on the back frame, wherein the back frame includes at least one pivot mounting structure, and the flange forms a reinforcement for the at least one pivot mounting structure.

2. The back construction defined in claim 1, wherein the at least one pivot mounting structure includes a pair of spaced apart pivot mounts.

3. The back construction defined in claim 2, wherein the flange extends between the pair of pivot mounts.

4. The back construction defined in claim 3, wherein the flange has one of a locator protrusion and a locator hole, and the aesthetic cover includes the other of the locator protrusion and the locator hole, the locator protrusion being configured to engage the locator hole to locate the cover on the elongated section.

5. A back construction for seating comprising:

a structural back frame having an elongated section with a visible area where a blemish or other visible defect is undesirable; and an aesthetic cover engaging opposing surfaces on the elongated section and that is shaped to aesthetically cover the visible area, the aesthetic cover being C shaped, and including front and rear panels.

6. The back construction defined in claim 5, wherein the aesthetic cover includes a resilient connecting section that resiliently connects the front and rear panels, such that the front and rear panels can be sprung apart to receive the flange and then released to resiliently snappingly engage the flange.

7. The back construction defined in claim 5, wherein one of the front and rear panels includes alphanumeric indicia.

8. The back construction defined in claim 5, wherein one of the front and rear panels includes locator structure, and wherein the flange includes mating locators for engaging the locator structure to locate the cover on the flange.

9. A back construction for seating comprising:

a structural back frame having an elongated section with a visible area where a blemish or other visible defect is undesirable;

an aesthetic cover engaging opposing surfaces on the elongated section and that is shaped to aesthetically cover the visible area; and wherein the elongated section includes an attachment boss for attaching a back component thereto, and wherein the cover includes front and rear portions that engage the elongated section, one of the front and rear portions having a cutout area for receiving the attachment boss.

10. A back construction for seating comprising:

a back frame;

a back shell; and a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; the sleeve having a first end mateably slidably engaging the back frame.

11. The back construction defined in claim 10, wherein the sleeve has a second end positioned close to the back shell.

12. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and a screw threadably engaging the sleeve and that extends through the sleeve into engagement with the internal connecting structure to secure components of the internal connecting structure together.

13. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and wherein the internal connecting structure includes radially extending flanges on the internal connecting structure and further includes radially extending mating ridges on the housing that engage the radially extending flanges on the internal connecting structure.

14. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and wherein the internal connecting structure includes first bearing surfaces that slidably engage to allow pivotal movement of the connection, and further the external retainer housing includes second bearing surfaces that slidably engage to allow pivotal movement of the connection.

15. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and wherein the back frame includes an attachment boss and at least one stud extending from the attachment boss toward the back shell, and wherein the internal connecting structure includes a retainer bushing secured to the stud, the external retainer housing including a radiused end wall, the retainer bushing slidably engaging the radiused end wall on the external retainer housing and biasing the radiused end wall against a similarly radiused surface on the back frame in a manner permitting some pivoting of the connection.

16. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and wherein the back shell includes at least one boss, and the internal connecting structure includes a retainer ring secured to the boss, the retainer ring including an outwardly extending lip that engages inwardly extending ridges on the sleeve.

17. A back construction for seating comprising:

a back frame;

a back shell;

a connection connecting the back shell to the back frame, the connection including internal connecting structure on the back shell and the back frame that securely engage to hold the back shell to the back frame and further including an external retainer housing surrounding the internal connecting structure, the external retainer housing including a tubular sleeve that provides an aesthetic appearance around the internal connecting structure; and wherein the back frame includes a first boss and a stud extending from the first boss, wherein the back shell includes a second boss and a retainer ring extending from the second boss, and wherein the internal connecting structure includes a bushing secured to the second boss that captures an end of the retainer housing between the bushing and the first boss, the internal connecting structure further including ridges on the sleeve that frictionally engage an outwardly extending lip on the retainer ring, the internal connecting structure still further including a fastener engaging the sleeve that, when extended inwardly, biases the lip of the retainer ring against the ridges on the sleeve.

18. A back construction comprising:

a back support having sides and a bottom edge and a channel defined along the bottom edge; and an elongated bracket having a center section shaped to fit into the channel, the bracket being retained in the channel and having end sections that extend forwardly from the sides of the back support, the end sections being adapted to pivotally engage a back frame structure.

19. The back construction defined in claim 18, wherein the back support includes a back shell made at least in part from polymeric material.

20. The back construction defined in claim 19, wherein the back shell includes a body and further includes top and bottom flanges on the body that form the channel.

21. The back construction defined in claim 20, wherein the top flange forms a concavely shaped pocket that faces toward the bottom flange.

22. The back construction defined in claim 21, wherein the center section includes a nose shaped to releasably and mateably engage the concavely shaped pocket.

23. The back construction defined in claim 20, wherein the bottom flange includes holes and fasteners extended through the holes and into secure engagement with the center section of the elongated bracket.

24. The back construction defined in claim 20, wherein the bottom flange defines a downwardly facing recess that is deeper than it is wide, and that is shaped and adapted to receive a stiff strip sewn to fabric.

25. The back construction defined in claim 24, wherein the bottom flange is L shaped, and includes a first leg perpendicular to the body, and a second leg that extends from the first leg in a direction parallel a rear surface of the body, and including reinforcement gussets that extend from the rear surface of the body toward the second leg, but that terminate short of the second leg.

26. The back construction defined in claim 25, wherein the first leg includes holes for receiving screws, and including screws that extend through the holes into a bottom of the bracket.

27. The back construction defined in claim 19, wherein the bracket is made of polymeric material.

* * * * *